United States Patent [19]

Fischmeister et al.

[11] 4,038,738

[45] Aug. 2, 1977

[54] METHOD AND MEANS FOR THE PRODUCTION OF BAR STOCK FROM METAL POWDER

[75] Inventors: Hellmut Fischmeister, Molndal; Väino Lampe, Hagfors; Leif Olsson, Goteborg, all of Sweden

[73] Assignee: Uddeholms Aktiebolag, Hagfors, Sweden

[21] Appl. No.: 539,996

[22] Filed: Jan. 10, 1975

[51] Int. Cl.[2] ..... B22F 3/24

[52] U.S. Cl. ..... 29/420.5

[58] Field of Search ..... 29/420, 420.5

[56] References Cited

U.S. PATENT DOCUMENTS

| | | | |
|---|---|---|---|
| 2,155,651 | 4/1939 | Goetzel | 29/420.5 |
| 3,834,002 | 9/1974 | Sissons et al. | 29/420 |

*Primary Examiner*—C.W. Lanham
*Assistant Examiner*—V. K. Rising
*Attorney, Agent, or Firm*—Pierce, Scheffler & Parker

[57] ABSTRACT

A method for powder metallurgical production of bar stock from an iron, nickel or cobalt based alloy comprises the steps of introducing a powder of the desired alloy into a tubular container together with a reducing agent and an oxygen getter, sealing the container without evacuating it, heating the sealed container and the powder therein, compacting the heated container by progressive forging and rolling the forged blank. Equipment for forging the container includes a tool having upper and lower dies defining between them an open-ended forging cavity which tapers from an entrance end towards an exit end and through which the container is fed in step-wise manner.

13 Claims, 6 Drawing Figures

A
B
C
D
E
F
G
H
10
11
12
21
22
23
24
30
31
32
33
37
40
50
60
64
70
80
81
82

METHOD AND MEANS FOR THE PRODUCTION OF BAR STOCK FROM METAL POWDER

The present invention relates to powder metallurgical manufacture of bar stock and semi-finished articles from iron, nickel, or cobalt based materials.

Powder metallurgical manufacture of semi-finished articles has, for quite a long time, been the object of studies and experiments. Mainly, the ideas put forward have, so far, remained at the experimental stage and have been considered as little more than technical curiosities. However, during the last 10 years development work in this field has intensified. While previously this development work was mainly related to materials such as beryllium, titanium, zirconium and refractory metals, other kinds of metals, such as high speed steel, tool steel and superalloys, i.e., iron, nickel and cobalt based materials, which are used in comparatively large quantities, have now come to the fore, and processes which are technically viable have been developed to produce bar stock and semi-finished articles from powders of iron, nickel and cobalt based materials. However, these processes are very expensive, requiring the use of powders of very low oxygen content and heavy specialised equipment for compaction, e.g., isostatic hot compaction.

The present invention is concerned with providing a method, which on the one hand can be applied economically on a practical scale for the manufacture of semi-furnished articles and stock in the form of bars from iron, nickel or cobalt based materials, and which, on the other hand, gives a high grade product, viz, one of low porosity and good particle bonding in the finished product.

For reasons of economy, it is also necessary that the process shall not require complicated and expensive equipment nor involve elaborate procedures. In addition, it should be possible to make use of powders which are not oxygen-free and it should also be possible to employ the method in an atmosphere which is not oxygen-free. It is not possible to meet these requirements in previous procedures, if a product of low porosity and good particle bonding is to be obtained. However, the present invention permits the production of such products by a much simpler procedure than was previously necessary.

The present invention provides a process for the production by a powder metallurgy technique of bar stock and semi-finished articles from an iron, nickel or cobalt based alloy which comprises introducing a powder of the desired iron, nickel or cobalt based alloy, which need not necessarily be substantially free from oxygen and which can be permitted to undergo a certain degree of oxidation, into a container, hereinafter called capsule, together with a material with affinity for oxygen (a getter), sealing the capsule, heating the alloy to a forging temperature, forging the closed capsule with the powder and then shaping the forged blank into a desired shape, for example rolling it between grooved rolls to form bars.

It is useful to add an oxygen carrier, preferably carbon, to the powder. The use of a halogen is also possible for this purpose. By an "oxygen carrier" we mean a substance which will set free oxygen from its bound state in the oxide skins on the particle surface, and bind it in gaseous form so that it can be carried over to the getter.

Preferably, the sequence of steps in the process of the invention is as follows:

1. Manufacture of the powder which involves melting and atomizing.
2. Mixing an oxygen carrier into the powder, the oxygen carrier being preferably carbon in the form of graphite, or possibly, a halogen compound.
3. Application of the getter to the wall of the capsule.
4. Charging the capsule.
5. Closing the capsule.
6. Heating to a temperature suitable for progressive forging.
7. Progressive forging in a special tool.
8. Heating to a temperature suitable for rolling.
9. Rolling the forged blanks, preferably by means of grooved rolls, into bars of the desired shape.

The process according to the invention will now be described more in detail and certain modifications of the process as set forth above will also be disclosed, reference being made to the figures in the accompanying drawings. In the drawings.

Figure 1:
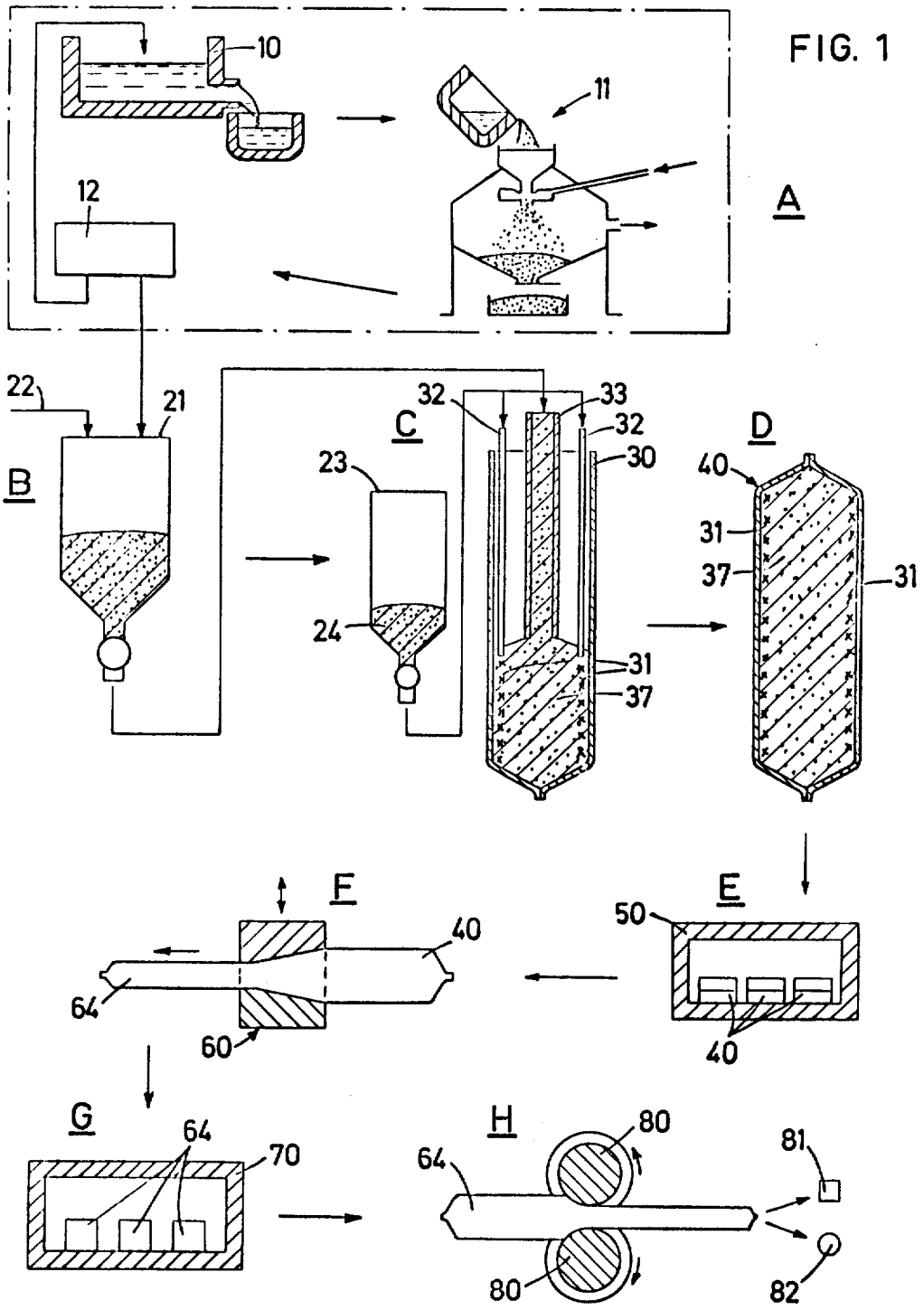
FIG. 1 shows a flow diagram which illustrates the process according to the invention.

Referring first to FIG. 1, the process can be carried out in the following stages A to H:

A. forming powder
B. mixing powder with oxygen carrier
C. loading capsule
D. closing capsule
E. heating capsule
F. progressive forging
G. heating forged blank
H. rolling forged blank.

As illustrated at stage A of FIG. 1, the equipment used for the manufacture of the powder comprises a furnace 10 for preparing or melting the alloy, an atomizer 11 and a separator 12 for separating and screening the powder formed in the atomizer.

The melting furnace 10 can be of a known kind, e.g., an induction furnace. The molten alloy is transferred to the atomizer 11 in which the powder is formed in the ordinary way by gas spraying in an atmosphere that is essentially inert. Gases suitable for this purpose are argon, nitrogen, and helium. However, experiments indicate that there is no need for the atmosphere to be completely inert, i.e., free from oxygen and in fact, satisfactory results have been obtained with powders containing up to 500 ppm of oxygen and nothing has so far indicated that this is the highest possible oxygen content. Indeed, it appears that oxygen contents of even between 500 and 1,000 ppm, and beyond 1,000 ppm, too, would, in principle, be quite acceptable. This would make it possible to atomize the alloy by spraying with water, e.g., in a water atomizing plant of the kind in which a high-pressure water jet impinges obliquely on a vertical jet of the molten alloy, and thus adds to the economic advantages of the process according to the invention.

The powder is screened in separator 12. Oversize particles are returned to the melt in the furnace 10, and although this has not been indicated in FIG. 1, any undersize particles are also diverted.

In this way a pre-alloyed powder is obtained which will, normally, contain all desired alloying elements such as are to be included in the finished material. However, some further additions to the alloy, e.g., carbides or dispersion agents, may be desirable. Powder mixes consisting, at least partly, of elementary particles, can also be suitable where the intention is to produce composite materials or compound materials.

Because a pre-alloyed powder is made up of a large number of micro-ingots, which are throughout homogeneous and of identical composition, particle size can be allowed to vary within comparatively wide limits. A pre-alloyed powder can have a particle diameter of 1 μm to 2,000 μm, while for elementary powders the particle size should vary only within a very narrow range and the maximum size should not exceed 6 μm in order to bring about production of homogeneous materials.

It has already been mentioned that, in this invention, comparatively high oxygen contents can be allowed in the powders. Accordingly, it is not necessary that the atomization in atomizer 11 should take place in a completely oxygen-free atmosphere.

From separator 12 the pre-alloyed powder is transferred to a blender 21 (at B), where an oxygen-carrier is supplied through a line 22 and admixed to the powder. The function of the oxygen-carrier in the process is to transport the oxygen from the metal oxides on the surfaces of the particles to the getter, which will be described below. In a preferred embodiment of the invention, carbon in the form of a finely divided graphite powder is used as the oxygen carrier. The required quantity of graphite will be dependent, first and foremost, upon the oxygen content of the powder. Experiments have shown that, allowing for the oxygen content and the carbon content of the pre-alloyed powder and for the method used for applying the graphitic powder, an amount of graphite in the range of 0.03–0.15 percent by weight is usually suitable.

Referring to stage C, a storage container 23 contains a material 24 having affinity for oxygen and the capacity to bind oxygen to itself more firmly than does that metal which is the predominant constituent of the powder particles. The function of the oxygen-affinitive material is, consequently, that of a getter for oxygen and, possibly, for nitrogen in the capsules. The getter is applied to the inner side of the wall of the capsule. It is also possible to attach the getter to the wall of the capsule before filling it, by means, for instance, of an adhesive agent, such as gum arabic, or in any other practical manner. One particular method is illustrated at C in FIG. 1 in which the getter powder 24 is introduced into the tubular steel capsule 30 through conduits 32 while at the same time the mixture of the alloy powder and carbon is being charged to the capsule from blender 21 through a central tube 33. The open outlet ends of the conduits 32 which extend along the walls of the capsule 30 are, during this operation, located at a lower level than the outlet end of tube 33, whereby the bed of powder 37, as and when formed, fixes the getter 31 along the walls of the capsule as the powder is charged to capsule which is slowly lowered. An advantage of applying the getter all around the wall of the capsule 30 is that the layer of getter substance assists in the removal of the capsule 30 after the forging. Furthermore, the bond between the capsule and the forged alloy blank should be reduced to a minimum in order to conteract the tendency to the formation of cracks at the edges of the blank during the progressive forging operation.

When the capsule 30 has been completely filled with powder, the capsule is hermetically closed by pressing together the open end of the capsule without having previously evacuated the air, stage D.

Filled and closed capsules 40 are now heated to a temperature suitable for the progressive forging, for instance 800°–1,250° C, in a furnace 50, stage E.

During the progressive forging, stage F, the heated capsules are progressively compacted between upper and lower parts of a forging tool 60 which are relatively reciprocable in the vertical direction and define between them an open-ended cavity or forging zone through which the capsules are fed. During this forging, certain reducing processes, characteristic for the invention, take place. When the oxygen carrier is carbon, the carbon combines with the oxygen of the air present in the capsule 40 forming carbon oxides which, along with the elementary carbon, reduces the metal in the layer of oxides on the powder particles. The resulting CO and $CO_2$ diffuse towards the walls of the capsule where the gases react with the getter. In this way, a low oxygen potential is constantly being maintained internally in the capsule.

Experiments have shown that titanium is a metal with a suitable oxygen affinity for use as a getter. Other metals which can be used for this purpose include aluminum, calcium, and magnesium. If metals with basically low melting points are used, such as aluminum, it is advisable that mechanical obstacles should be provided preventing the metal from entering into the powder material, for instance a blocking layer of asbestos or of graphitic felt. If titanium is used as the getter, it is convenient, in an industrial process, to use titanium in the form of ferrotitanium, which is available to a much lower price than pure titanium.

While no exact theory can be set forth, an account will now be given of the simple chemical reactions believed to occur which can be assumed to explain the successful results obtained in this invention. However, no limitations are intended by such account.

In operation of the method according to the invention, air with its natural content of oxygen is present, as well as a certain amount of carbon, in the capsule at the start of the forging. The oxygen contained in the air reacts with the carbon in accordance with the following equations (1) and (2):

| | |
|---|---|
| $2C + O_2 \rightarrow 2CO$ (1) | $CO + MeO \rightarrow Me + CO_2$ (3) |
| $C + O_2 \rightarrow CO_2$ (2) | $C + MeO \rightarrow Me + CO$ (3a) |

The carbon monoxide obtained according to equation (1) reacts as in equation (3) with any metal oxide (MeO) present on the powder particles, i.e., the metal is reduced so that $CO_2$ is produced. At the same time, a reaction involving a direct reduction takes place according to equation (3a); this reaction (3a) will dominate in the case of oxides that are hard to reduce.

The carbon monoxide and the carbon dioxide both react in the known way at the walls of the capsule, with the getter applied there, e.g., titanium. The nitrogen of the air combines with titanium, yielding titanium nitride. In this way, the process continues until, in the main, all the air in the capsule has been consumed and all metal oxide has been reduced. The end products are made up of compounds of titanium, oxygen, nitrogen, and carbon at the walls of the capsule, and, internally in the capsule, a body that has been compacted and sintered by the forging and by the heat added. The compacted body has a very low porosity and an excellent bonding of the individual particles.

Oxygen carriers other than carbon can be used, such as certain halides, preferably chlorides, e.g., $FeCl_2$, $FeCl_3$, $CoCl_2$ and $CrCl_3$. In this context, the best choice is a chloride of one of the metals present in the alloy powder. Using one of the chlorides, with a suitably low stability in the context of this particular purpose, the basis is provided for a reaction between the chloride and the metal oxide on the particles yielding a volatilizable oxychloride of the metal involved. In its turn, the metal-oxychloride is to combine with the getter, which, in this case, should have a high degree of affinity with oxygen as well as with the halide involved. In principle, chlorides that are not formed from a metal, such as ammonium chloride, $NH_4Cl$, can also be used as oxygen carriers.

Ti, Ca, and Mg can be used as getters when halides are used as oxygen carriers. The above mentioned combinations of halides and getter metals are being indicated only as examples. With the indicated principles as guides, alternative combinations can be selected for a viable process with practical applications.

Of great economic value is the fact that in the process according to the invention there is no need for the capsules to be evacuated before sealing a preferred feature of the process according to the invention is that evacuation of the capsules before sealing is excluded.

Figure 2:
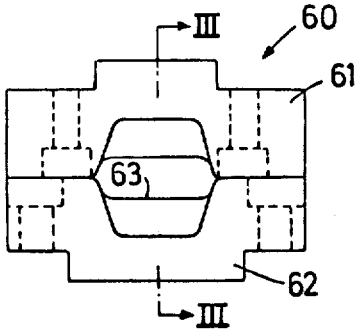
FIG. 2 shows a tool for progressive forging, viewed from the entrance end.
Figure 3:
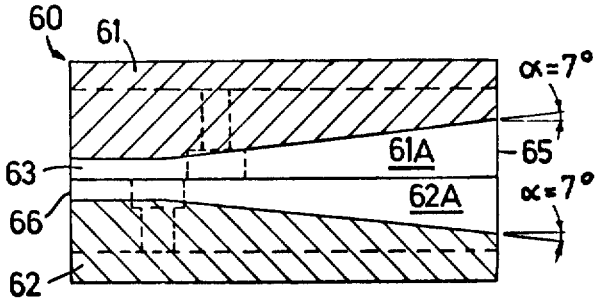
FIG. 3 is a sectional view on line III—III of FIG. 2.
Figure 4:
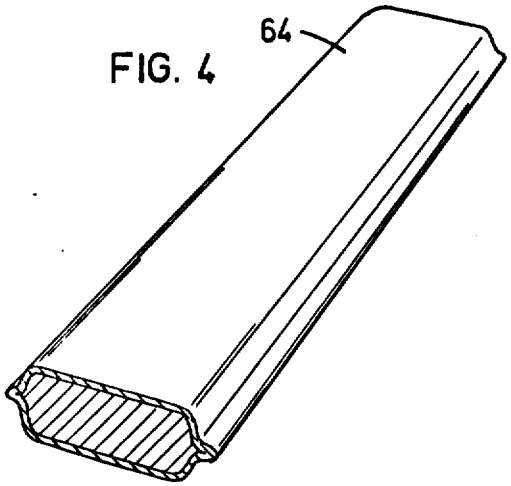
FIG. 4 shows a progressively forged blank ready for rolling between grooved rolls.

A further feature of the process according to the invention, which is of great economic importance, is the fact that there is no need for the capsules to be pre-compacted before heating but that, instead, the closed capsules, without undergoing any kind of treatment, are heated to forging temperature and then directly forged. For the desired degree of compacting to be brought about by this operation, it is of paramount significance that the working is carried out as a step or progressive forging operation and that the tool has a suitable form. Particular attention should be given to the entrance angle of the forging tool. Experiments have shown that this angle should be in the range 4° to 12° and preferably be between 5° and 10°. Furthermore, is is advisable that the tool should have a forging zone or cavity in the form of a double wedge with equal entrance angles, namely 4°-12° and preferably 5°-10°, in the upper and the lower tool parts. More exactly, the tool should have trough or channel shaped recesses defining a double wedge having slanting side walls to facilitate the release of the forged blank. FIGS. 2 and 3 illustrate an embodiment of a tool 60 for the production of the blank 64 in stage F. In FIG. 4, this blank 64 is shown in cross-section at one end in order to provide a picture of the deformation of the capsule wall. The tool 60 comprises upper and lower parts 61 and 62 having trough or channel shaped recesses 61A and 61B defining an elongated open-ended cavity which will determine, with its innermost part 63, the cross-section of the blank 64. In the vertical plane, the cavity tapers from the entrance opening 65 to the narrower exit orifice 66. In the embodiment illustrated in FIGS. 2 and 3, the entrance angles $\alpha$ in both of the parts of the tool are 7°. In principle, the same construction as the one shown in FIGS. 2 and 3 can be used for tools for the production blanks with forms that are different from that shown in FIG. 4, for instance blanks with, in the main, circular cross-sections, the cavity in the tool being of a corresponding form.

The progressively forged blanks 64, as obtained in the manner illustrated at F in FIG. 1, are, before being rolled, heated to a temperature suitable for hot rolling, in a furnace 70, stage G, after which they are rolled, for instance by grooved rolls 80 in order to provide the desired form for the bar, stage H, a square and a circular cross-section being shown at 81 and 82 by way of example. The operation is completed by the removal of the material which makes up the capsule. Alternatively, this can be done before the final hot rolling operation, however, not without loss of a certain quantity of compacted and sintered material inside the walls of the capsule, due to oxide formation of the surface of the bar. The following examples are given to illustrate the invention. (all percentages are on a weight/weight basis unless otherwise indicated).

EXAMPLE 1

The apparatus used was that illustrated in FIGS. 1-3. A pre-alloyed powder was used consisting of a steel alloy with the following approximate composition: 0.25% C, 0.60% Si, 0.40% Mn, 11.5% Cr. 7.5% W, 9.5% Co, 0.5% V, the rest iron and inevitable impurities. The average particle size of the powder was approximately 0.2 mm.

On the surface of the pre-alloyed powder there was, in all cases, a thin oxide film probably consisting of complex oxides of the metals, Fe, Cr, Si, and Mn, the composition being partly dependent upon the partial pressure of the oxygen in the atomizer and upon the temperature at which the finished powder was exposed to the atmospheric oxygen. The oxygen content of the powder varied between 300 and 1,000 ppm. In addition to the oxide film, there was also present a complex slag of manganese-silicon. The powder was placed in capsule tubes of stainless steel having an outer diameter of 38 mm.

In a first series of experiments eight capsules were filled with the above mentioned powder in quantities that varied between approximately 800 and 1,300 g. Carbon was also present in the powder in the quantity indicated below. The capsules were then sealed without previous evacuation of air. Before sealing, a trial was first made with a cap that was welded to the capsule. However, it turned out that the sealing of the capsule by squeezing was the better method. 7 of the eight capsules contained a getter as indicated below in Table 1.

Table 1

| Experiment | Getter | Quantity of carbon (based on weight of alloy powder) |
|---|---|---|
| 1 | 12 g titanium at capsule wall | 0.08% |
| 2 | 12 g titanium at capsule wall | 0.08% |
| 3 | 1.5 g magnesium at one end | 0.08% |
| 4 | 12 g titanium at capsule wall | 0.08% |
| 5 | 9 g titanium at one end | 0.08% |
| 6 | Al-foil wound against wall | 0.08% |
| 7 | 1.08 g magnesium at one end | 0.08% |
| 8 | No addition | None |

The carbon was finely divided graphite powder. As mentioned above, titanium proved to be the superior getter while, in fact, the other substances have greater reduction capability but show a tendency to penetrate into the powder bed and, therefore, necessitate particular devices in order to prevent mechanically the reducing metal from entering the powder bed.

The quantity of metal used as getter in a process under practical conditions can be significantly reduced in comparison with the amounts indicated in Table 1. In fact, during these experiments more than 10 times as much titanium was used as theoretically required for the binding of all the oxygen in the capsule. It is advisable that the titanium should be added in the form of a finely divided powder which, furthermore, should be newly milled. With titanium as getter, a high furnace temperature is necessary. Experiments show that when titanium is used as getter a suitable temperature is 1100°-1250° C, while heating time is directly dependent on capsule dimensions. In most cases, the furnace temperature varied between 1100° and 1160° C, while the capsules were heated to forging temperature for 1 hour. Upon progressive forging and subsequent rolling by means of grooved rolls, excellent particle bonding was obtained, particularly so with regard to specimens obtained with Ti as a getter metal and using graphite. Breaking tests on these speciments, after progressive forging and rolling by means of grooved rolls, gave trans-particle fractures over the entire surface of the fracture, which proves that the adjoining surfaces of particles do not constitute the weakest part of the structure. A test carried out, for the purpose of comparison, with a specimen with Mg as a getter and with no added carbon produced a throughout inter-particle rupture, and the signs of metallic bonds in the surface of the rupture were negligible.

EXAMPLE 2

In order to test the significance of the content of oxygen in the powder, the procedure described in Example 1 was repeated to prepare specimens where the powder oxygen content was as high as 1,000 ppm. Reduction was, in one case, carried out with 0.1% of carbon together with 0.5% of titanium, and in another case with 0.05% of carbon together with 0.5% of titanium, with the titanium located along a longitudinal line on the capsule wall. The resulting fracture surfaces had different aspects in various regions of the fracture. In fact, in certain regions, excessive amounts of oxides were left on adjoining particles after the progressive forging, causing an inter-particle rupture. This test shows that it is possible, by selection of a suitable distribution and appropriate means of application, respectively, of oxygen-carrier and reducing metal, to progressively forge powders with a content of oxygen as high as 1,000 ppm.

Figure 5:
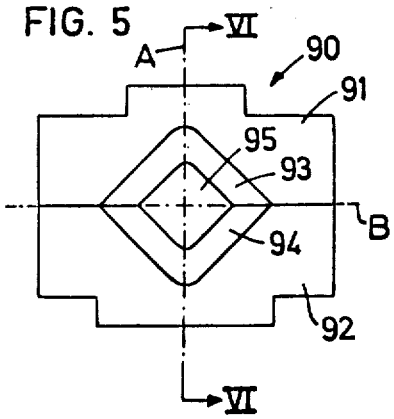
FIG. 5 shows another tool for progressive forging, viewed from the entrance end.
Figure 6:
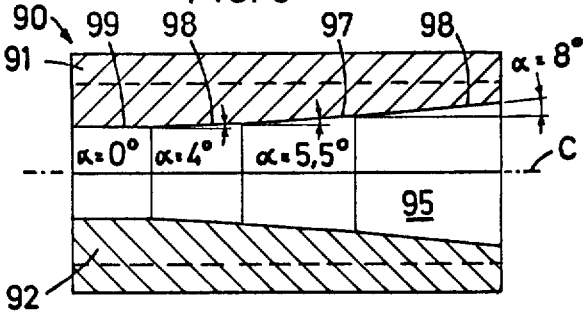
FIG. 6 is a sectional view on line VI—VI of FIG. 5.

FIGS. 5 and 6 show the presently preferred embodiment of the forging tool used in stage F to produce blanks from the closed capsules.

The tool shown in FIGS. 5 and 6 is generally designated 90 and comprises an upper half 91 and a lower half 92 having respectively an upper forging surface 93 and a lower forging surface 94. The forging surfaces 93 and 94 are formed by the walls of opposed V-shaped grooves or channels and jointly define an open-ended cavity or forging zone 95 of diamond cross-section which is symmetrical about two orthogonal axes A and B. As shown in FIG. 6, the two tool halves 91,92 and the forging zone 95 are also symmetrical about a longitudinal axis C defined by the line of intersection of a vertical center plane containing the axis A and a horizontal parting plane containing the axis B. When the tool 90 is closed as shown, the two halves engage each other in the parting plane.

The entrance angle of the forging zone, which is the angle $\alpha$ included between the longitudinal axis C and each line of intersection of the two above-mentioned planes with the surfaces 93 and 94 defining the forging zone 95, is not constant, but decreases from the entrance end of the forging zone towards the exit end. The decrease may be continuous or in steps of 1°-3°. At the entrance end of the forging zone, the entrance angle should be in the range of 4°-12° and particularly between 5° and 10°. As shown in FIG. 6, the entrance angle is 8° in a first section 96 of the forging zone 95, 5.5° in a second section 97, 4° in a fourth section 98 and zero in a final section 98 determining the final cross-section of the forged blank. Preferably the transitions between the different sections are rounded.

As is apparent from FIG. 5, throughout the length of the forging zone 95, all four quadrants of the cross-section of the forging zone defined by the two axes A and B are substantially congruent. During the progressive forging, when the heated capsule is introduced into the forging tool 90 and gradually fed through the forging zone in a step-wise manner to be reduced in accordance with the shape of the forging zone, the capsule is therefore rotated 90° about its longitudinal axis in between successive forging steps. The resulting forged blank is substantially free from flash and may be subjected to a rolling operation as described above with reference to FIG. 1 (stage H). The absence of flash is an advantage over the tool shown in FIGS. 2 and 3 which causes the formation of flash along the sides of the forged blank, as seen in FIG. 4. Such flash is undesirable as it may interfere with the rolling operation.

We claim:

1. A method for producing from a powder of alloys based on iron, nickel or cobalt bar stock having low porosity and good particle bonding, comprising the sequential steps of providing along the inner side only a hollow capsule an oxygen-affinitive reducing material having the ability to bind oxygen to itself more firmly than has the metal which is the predominant constituent of the powder particles, filling the capsule with the powder and an oxygen carrier to constitute a powder mass in the capsule, hermetically sealing the capsule and compacting the powder mass in the capsule by progressive forging of the capsule at a temperature in the range of 900°-1200° C, whereby a blank is formed and the oxygen carrier combines with oxygen in the powder mass to form a gas which is transported towards the inner side of the capsule and reacts there with the oxygen-affinitive material and removing the capsule from the blank.

2. A method as claimed in claim 1 in which the oxygen-affinitive material is a material also having affinity for nitrogen.

3. A method as claimed in claim 1 in which the oxygen-affinitive material is titanium.

4. A method as claimed in claim 1 in which the oxygen carrier is carbon.

5. A method as claimed in claim 1 in which the oxygen carrier is a halide.

6. A method as claimed in claim 5 in which the oxygen-affinitive material is selected from the group consisting of of titanium, calcium and magnesium.

7. A method as claimed in claim 6 in which the oxygen carrier is a chloride of one of the metals present in the alloy powder.

8. A method as claimed in claim 1 in which the oxygen carrier in finely divided form is admixed to the powder before the powder is introduced into the capsule.

9. A method as claimed in claim 8 in which the oxygen-affinitive material is applied to the inner side of the capsule before the powder is introduced into the capsule.

10. A method as claimed in claim 8 in which the oxygen-affinitive material in finely divided form is introduced into the capsule simultaneously with the introduction of the powder.

11. A method as claimed in claim 1, in which the progressive forging of the capsule is effected in a forging tool including upper and lower halves which are relatively reciprocable in the vertical direction and define between them an open-ended forging zone having an entrance portion the cross-section of which gradually decreases from one end of the forging zone towards the other.

12. A method as claimed in claim 1, in which the blank obtained through the progressive forging is further compacted and reduced in cross-section by rolling between grooved rolls.

13. A method for producing from a powder of alloys based on iron, nickel or cobalt bar stock having low porosity and good particle bonding, comprising the sequential steps of providing along the inner side only of a hollow capsule an oxygen-affinitive reducing material having the ability to bind oxygen to itself more firmly than has the metal which is the predominant constituent of the powder particles, filling the capsule with the powder admixed with an oxygen carrier in finely divided form to constitute a powder mass in the capsule, heremetically sealing the capsule and compacting the powder mass in the capsule by progressive forging of the capsule at a temperature in the range of 900°–1200° C., whereby a blank is formed as the oxygen carrier combines with oxygen in the powder mass to form a gas which is transported towards the inner side of the capsule and reacts there with the oxygen-affinitive material and removing the capsule from the blank, the method being further characterized in that the capsule is a vertical steel tube held in vertical position during the introduction of the powder and the oxygen-affinitive material into the capsule, the powder is gradually introduced into the capsule through a vertical tube extending into the capsule coaxially therewith and the oxygen-affinitive material is gradually introduced into the capsule at locations below the surface of the introduced powder through a plurality of vertical tubes extending into the tube along the inner side thereof at circumferentially spaced locations.

* * * * *